US008147268B2

(12) United States Patent
Shuey et al.

(10) Patent No.: US 8,147,268 B2
(45) Date of Patent: Apr. 3, 2012

(54) MEZZANINE-TYPE ELECTRICAL CONNECTORS

(75) Inventors: Joseph B. Shuey, Camp Hill, PA (US); Mark R. Gray, York, PA (US); Lewis Robin Johnson, Dover, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 12/616,807

(22) Filed: Nov. 12, 2009

(65) Prior Publication Data

US 2010/0055988 A1 Mar. 4, 2010

Related U.S. Application Data

(63) Continuation of application No. 11/847,666, filed on Aug. 30, 2007, now Pat. No. 7,635,278.

(51) Int. Cl.
*H01R 13/514* (2006.01)

(52) U.S. Cl. ..... 439/371; 439/289; 439/83; 439/74

(58) Field of Classification Search ..... 439/371, 439/83, 289, 293

See application file for complete search history.

(56) References Cited

U.S. PATENT DOCUMENTS

| | | | | |
|---|---|---|---|---|
| 741,052 | A | 10/1903 | Mahon | |
| 3,072,340 | A | 1/1963 | Dean | |
| 3,157,448 | A | 11/1964 | Crimmins et al. | |
| 3,461,258 | A * | 8/1969 | Shlesinger, Jr. | 200/253.1 |
| 3,482,201 | A | 12/1969 | Schneck | |
| 3,663,925 | A | 5/1972 | Proctor | |
| 3,827,007 | A | 7/1974 | Fairbairn et al. | |
| 3,867,008 | A | 2/1975 | Gartland | |
| 4,045,105 | A | 8/1977 | Lee et al. | |
| 4,148,543 | A | 4/1979 | Shores | |
| 4,232,924 | A | 11/1980 | Kline et al. | |
| 4,482,937 | A | 11/1984 | Berg | |
| 4,552,425 | A | 11/1985 | Billman | |
| 4,582,386 | A | 4/1986 | Martens | |
| 4,664,456 | A | 5/1987 | Blair et al. | |
| 4,664,458 | A | 5/1987 | Worth | |
| 4,737,118 | A * | 4/1988 | Lockard | 439/295 |
| 4,820,182 | A | 4/1989 | Harwath | |
| 5,030,121 | A | 7/1991 | Noorily | |
| 5,035,639 | A | 7/1991 | Kilpatrick | |
| 5,055,054 | A | 10/1991 | Doutrich | |
| 5,098,311 | A | 3/1992 | Roath et al. | |
| 5,127,839 | A | 7/1992 | Korsunsky et al. | |
| 5,161,985 | A * | 11/1992 | Ramsey | 439/74 |

(Continued)

FOREIGN PATENT DOCUMENTS

| | | |
|---|---|---|
| GB | 2299465 | 10/1996 |

(Continued)

OTHER PUBLICATIONS

MicroStac 0.8 mm Mezzanin Steckverbindersystem, ww.emi.com, Katalog, D 074,520, Feb. 2008, 23 Pages.

(Continued)

*Primary Examiner* — Truc Nguyen
(74) *Attorney, Agent, or Firm* — Woodcock Washburn LLP

(57) ABSTRACT

Embodiments of electrical connectors include substantially identical first and second halves. The first and second halves each include insert molded leadframe assemblies that comprise electrical conductors. Each electrical conductor of the first half engages a substantially identical electrical conductor of the second half when the first and second halves are mated.

10 Claims, 13 Drawing Sheets

U.S. PATENT DOCUMENTS 5,167,528 A * 12/1992 Nishiyama et al. ..... 439/489
5,181,855 A 1/1993 Mosquera et al.
5,334,029 A 8/1994 Akkapeddi et al.
5,382,168 A 1/1995 Azuma et al.
5,387,139 A 2/1995 McKee et al.
5,395,250 A 3/1995 Englert et al.
5,498,167 A 3/1996 Seto et al.
5,520,545 A 5/1996 Sipe
5,527,189 A 6/1996 Middlehurst et al.
5,562,442 A 10/1996 Wilhelm
5,573,409 A 11/1996 Shiley et al.
5,618,191 A 4/1997 Chikano et al.
5,664,968 A 9/1997 Mickievick
5,697,799 A 12/1997 Consoli et al.
5,730,606 A 3/1998 Sinclair
5,782,656 A 7/1998 Zell et al.
5,795,191 A 8/1998 Preputnick et al.
5,871,362 A 2/1999 Campbell et al.
5,893,761 A 4/1999 Longueville
5,902,136 A 5/1999 Lemke et al.
5,904,581 A 5/1999 Pope et al.
5,904,594 A 5/1999 Lougeville et al.
RE36,217 E 6/1999 Peterson
5,971,800 A * 10/1999 Azuma et al. ..... 439/502
5,984,690 A 11/1999 Riechelmann et al.
5,992,953 A 11/1999 Rabinovitz
6,022,227 A 2/2000 Huang
6,024,584 A 2/2000 Lemke et al.
6,074,230 A 6/2000 Comerci et al.
6,079,991 A 6/2000 Lemke et al.
6,097,609 A 8/2000 Kabadi
6,129,592 A * 10/2000 Mickievicz et al. ..... 439/701
6,146,208 A 11/2000 Pennell
6,152,747 A 11/2000 McNamara
6,154,742 A 11/2000 Herriot
6,164,983 A 12/2000 Lemke et al.
6,183,301 B1 2/2001 Paagman
6,193,537 B1 2/2001 Harper, Jr. et al.
6,193,557 B1 2/2001 Luvini et al.
6,241,535 B1 6/2001 Lemke et al.
6,379,170 B1 4/2002 Czeschka et al.
6,390,826 B1 5/2002 Affolter et al.
6,409,543 B1 6/2002 Astbury et al.
6,443,750 B1 9/2002 Lemke et al.
6,475,010 B1 * 11/2002 Yu ..... 439/289
6,494,734 B1 12/2002 Shuey
6,517,360 B1 2/2003 Cohen
6,537,087 B2 3/2003 McNamara et al.
6,540,529 B1 4/2003 Yu
6,641,410 B2 11/2003 Marvin et al.
6,699,048 B2 3/2004 Johnson et al.
6,702,590 B2 3/2004 Zaderej et al.
6,712,626 B2 3/2004 Harper, Jr. et al.
6,835,072 B2 12/2004 Simons et al.
6,851,954 B2 2/2005 Ashman
6,860,741 B2 * 3/2005 Ashman et al. ..... 439/70
6,869,292 B2 3/2005 Johnescu et al.
6,893,300 B2 5/2005 Zhou et al.
6,902,411 B2 6/2005 Kubo
6,918,776 B2 7/2005 Spink, Jr.
6,939,173 B1 9/2005 Elco et al.
6,951,466 B2 10/2005 Sandoval et al.
7,018,239 B2 3/2006 Zaderej et al.
7,153,170 B1 * 12/2006 Fabian ..... 439/680
7,182,608 B2 2/2007 Soh et al.
7,214,104 B2 5/2007 Minich et al.
7,220,141 B2 5/2007 Daily et al.
7,229,318 B2 6/2007 Winings
7,309,239 B2 12/2007 Shuey
7,407,387 B2 8/2008 Johnescu
7,452,249 B2 11/2008 Daily et al.
7,553,182 B2 6/2009 Buck
7,635,278 B2 12/2009 Shuey et al.
2002/0127903 A1 9/2002 Billman et al.
2004/0157477 A1 8/2004 Johnson et al.
2005/0079763 A1 4/2005 Lemke et al.
2005/0101188 A1 5/2005 Benham et al.
2005/0277315 A1 12/2005 Mongold et al.
2006/0051987 A1 3/2006 Goodman et al.
2006/0148283 A1 7/2006 Minich et al.
2006/0172570 A1 8/2006 Minich et al.
2007/0004287 A1 1/2007 Marshall

FOREIGN PATENT DOCUMENTS

GB 2312566 10/1997
GB 2345807 7/2000
JP 56-51269 A 5/1981
JP 1276575 11/1989
JP 2177277 7/1990
JP 2297509 12/1990
JP 51-43434 A 6/1993
JP 2003-317861 11/2003
WO WO 00/31832 6/2000
WO WO 2007/076901 7/2007

OTHER PUBLICATIONS

MicroStac 0.8 mm Mezzanine Steckverbindersystem, www.emi.com, Katalog D 074520, Feb. 2008, 24 pages.
U.S. Appl. No. 10/779,172, filed Feb. 11, 2004, Johnescu.
U.S. Appl. No. 10/940,329, filed Sep. 14, 2004, Johnescu.
U.S. Appl. No. 12/197,434: Final Rejection, dated Jun. 8, 2011, 7 pages.
U.S. Appl. No. 12/197,434: Final Rejection, dated Jul. 22, 2010, 7 pages.
U.S. Appl. No. 12/197,434: Non-Final Rejection, dated Dec. 29, 2010, 8 pages.
U.S. Appl. No. 12/197,434: Non-Final Rejection, dated Feb. 18, 2010, 8 pages.
U.S. Appl. No. 12/197,434: Non-Final Rejection, dated Sep. 2, 2009, 5 pages.
U.S. Appl. No. 12/197,434: Response to Official Action dated Sep. 2, 2009, filed Nov. 11, 2009, 7 pages.
U.S. Appl. No. 12/197,434: Response to Official Action dated Feb. 18, 2010, filed May 13, 2010, 8 pages.
U.S. Appl. No. 12/197,434: Response to Official Action dated Jul. 22, 2010, filed Oct. 22, 2010, 9 pages.
U.S. Appl. No. 12/197,434: Response to Official Action dated Dec. 29, 2010, filed Mar. 25, 2011, 11 pages.
U.S. Appl. No. 12/197,434: Response to Official Action dated Jun. 8, 2011, filed Oct. 7, 2011, 5 pages.

* cited by examiner

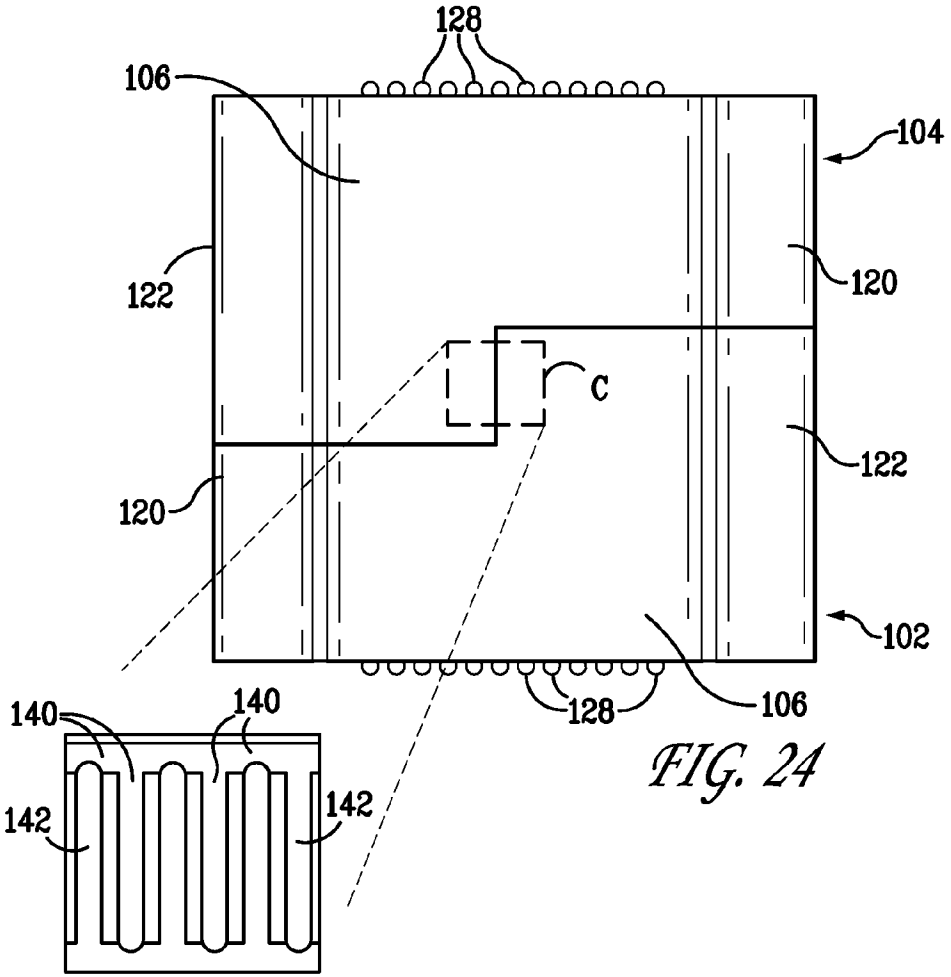
FIG. 24
FIG. 25
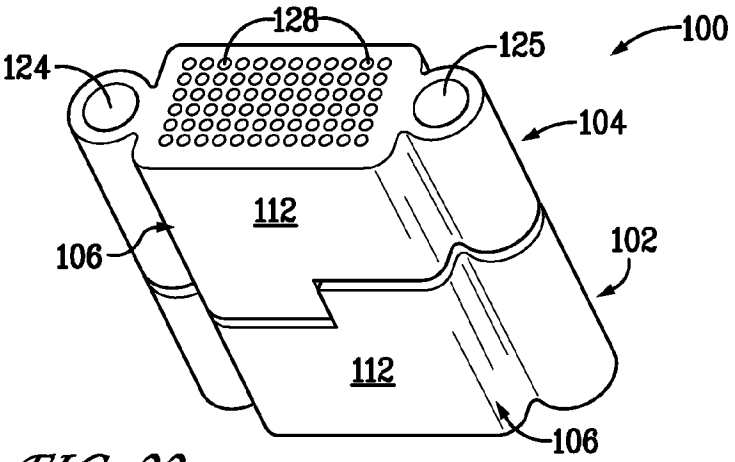
FIG. 22
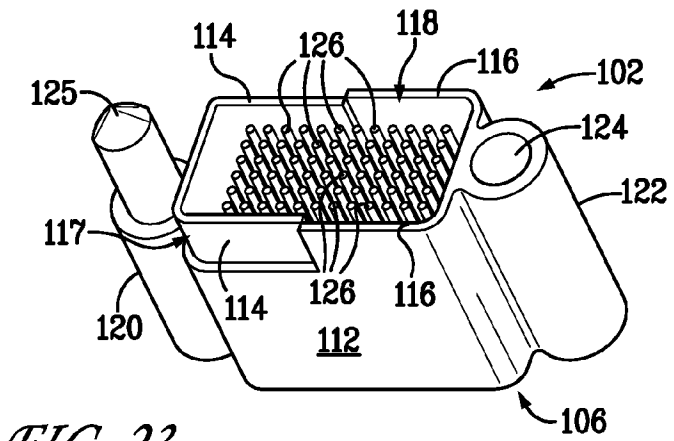
FIG. 23

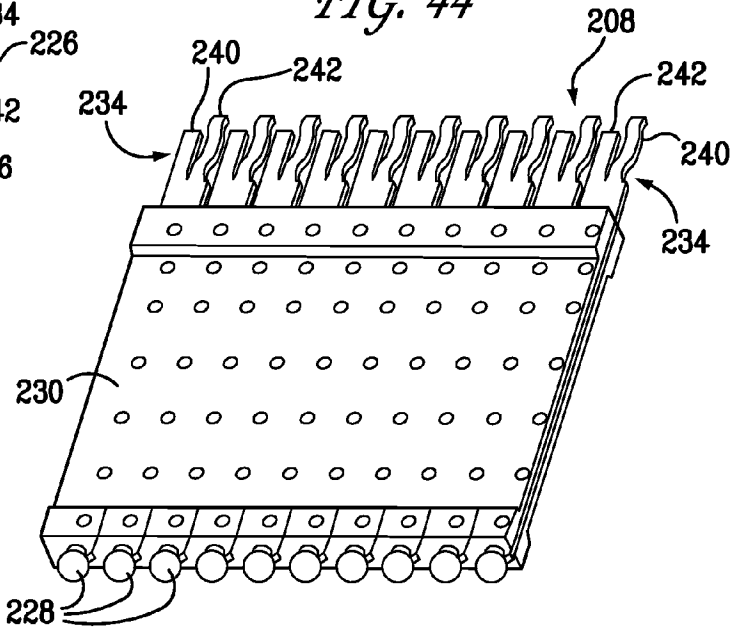
FIG. 44
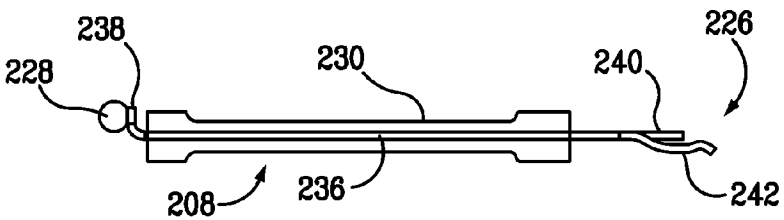
FIG. 45
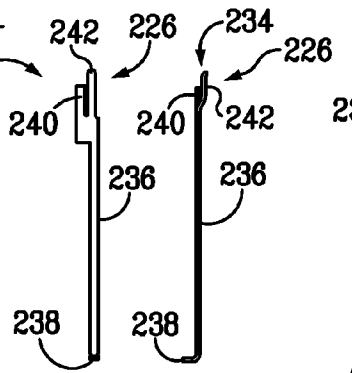
FIG. 43
FIG. 42
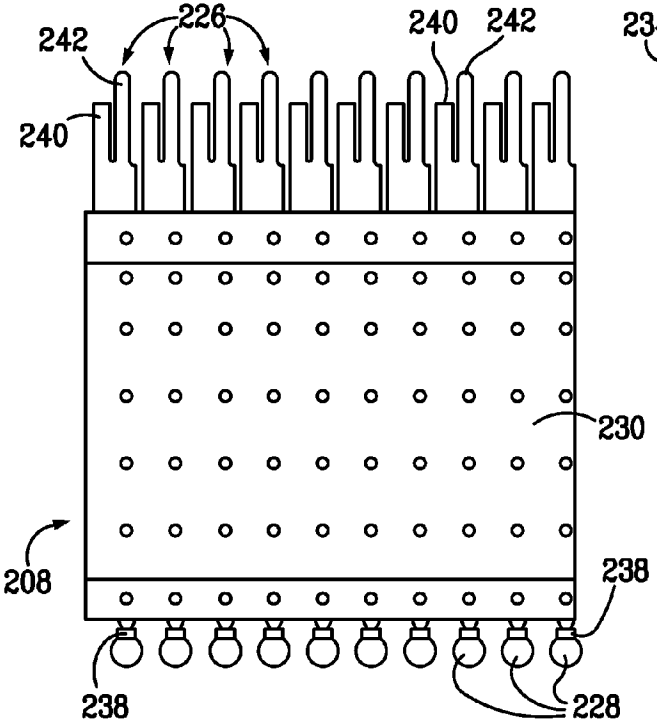
FIG. 39
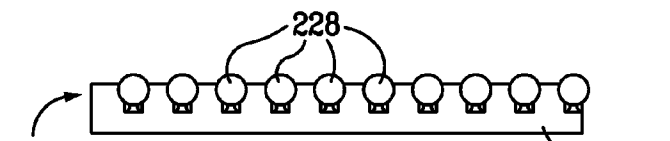
FIG. 40

MEZZANINE-TYPE ELECTRICAL CONNECTORS

CROSS-REFERENCE TO RELATED APPLICATIONS

This is a continuation application of U.S. patent application Ser. No. 11/847,666, filed Aug. 30, 2007, the disclosure of which is hereby incorporated by reference in its entirety herein.

FIELD OF THE INVENTION

The present invention relates to electrical connectors for connecting a first and a second electrical device such as a first and a second circuit substrate.

BACKGROUND OF THE INVENTION

Mezzanine-type electrical connectors may comprise a housing, a plurality of electrical conductors, and a plurality of fusible elements such as solder balls mounted on the electrical conductors. The solder balls are subjected to a reflow process that melts the solder. The molten solder, upon cooling, forms electrical and mechanical connections between the electrical conductors and a mounting substrate such as a printed circuit board.

The mezzanine connector may be equipped with locating features that help to maintain the solder balls in the proper location in relation to the electrical conductors during the reflow process. For example, pockets that each receive a portion of an associated solder ball can be formed in the housing. The use of such pockets usually requires the addition of structure to the housing that otherwise would not be required, thereby increasing the complexity and the manufacturing cost of the housing. Alternatively, pockets can be formed in a separate piece in addition to the housing, such as a base. This approach can increase the parts count and the manufacturing expense of the housing.

Mezzanine connectors commonly include a plug portion and a receptacle portion. In a typical installation, the plug portion is mounted on a first substrate, and the receptacle portion is mounted on a second substrate. The plug and receptacle portions mate to form electrical connections between the first and second substrates.

Because the plug and receptacle portions need to be mated, the plug and receptacle portions usually are not identical. The need for parts specific to one, but not the other of the plug and receptacle portions increases the number of different types of parts needed to construct the connector, potentially increasing manufacturing, tooling, and inventory-related costs.

SUMMARY OF THE INVENTION

Embodiments of electrical connectors include substantially identical first and second halves. The first and second halves each include insert molded leadframe assemblies that comprise electrical conductors. Each electrical conductor of the first half engages a substantially identical electrical conductor of the second half when the first and second halves are mated.

Embodiments of electrical connectors comprise a first half configured for mounting on a first surface, and a substantially identical second half configured for mounting on a second surface and being matable with the first half. The first and second halves each comprise a housing, and an insert molded leadframe assembly mounted in the housing and comprising a first and a second electrical conductor.

The first contact beam of the electrical conductor of the first half engages the second contact beam of the electrical conductor of the second half when the first and second halves are mated. The second contact beam of the electrical conductor of the first half engages the first contact beam of the electrical conductor of the second half when the first and second halves are mated.

Embodiments of electrical connectors comprise a housing and an insert molded leadframe assembly mounted in the housing. The insert molded leadframe assembly comprises an electrical conductor, an electrically-insulative frame positioned around the electrical conductor, and a fusible element mounted on the electrical conductor. The frame has a pocket formed therein that receives at least a portion of the fusible element.

Embodiments of electrical connectors comprise a first half mountable on a first substrate, and a substantially identical second half mountable on a second substrate and being matable with the first half to establish electrical contact between the first and second substrates.

The first and second halves each comprise an electrical conductor having a first and a second contact beam. The first contact beam of the electrical conductor of the first half engages the second contact beam of the electrical conductor of the second half. The second contact beam of the electrical conductor of the first half engages the first contact beam of the electrical conductor of the second half when the first and second halves are mated.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings:

FIG. 22 is a top perspective view of another alternative embodiment of the electrical connector shown in FIG. 1, depicting first and second halves of the connector in a partially mated condition;

FIG. 23 is a top perspective view of the first half of the connector shown in FIG. 22;

FIG. 24 is a side view of the connector shown in FIGS. 22 and 23, depicting the first and second halves of the connector in a fully mated condition;

FIG. 25 is a magnified view of the area designated "C" in FIG. 24, with housings of the first and second halves of the connector made transparent to reveal mated electrical conductors within the housings;

FIG. 39 is a side view of an insert molded leadframe assembly of the connector shown in FIGS. 32-38;

FIG. 40 is a bottom view of the insert molded leadframe assembly shown in FIG. 39;

FIG. 42 is a side view of the electrical conductor shown in FIG. 41;

FIG. 43 is a side view of the electrical conductor shown in FIGS. 41 and 43, from a perspective rotated approximately ninety degrees from the perspective of FIG. 42;

FIG. 44 is a bottom view of the insert molded leadframe assembly shown in FIGS. 39 and 40; and FIG. 45 is a side view of the insert molded leadframe assembly shown in FIGS. 39, 40, and 44, from a perspective rotated approximately ninety degrees from the perspective of FIG. 39.

DETAILED DESCRIPTION OF ILLUSTRATIVE EMBODIMENTS

Figure 1:
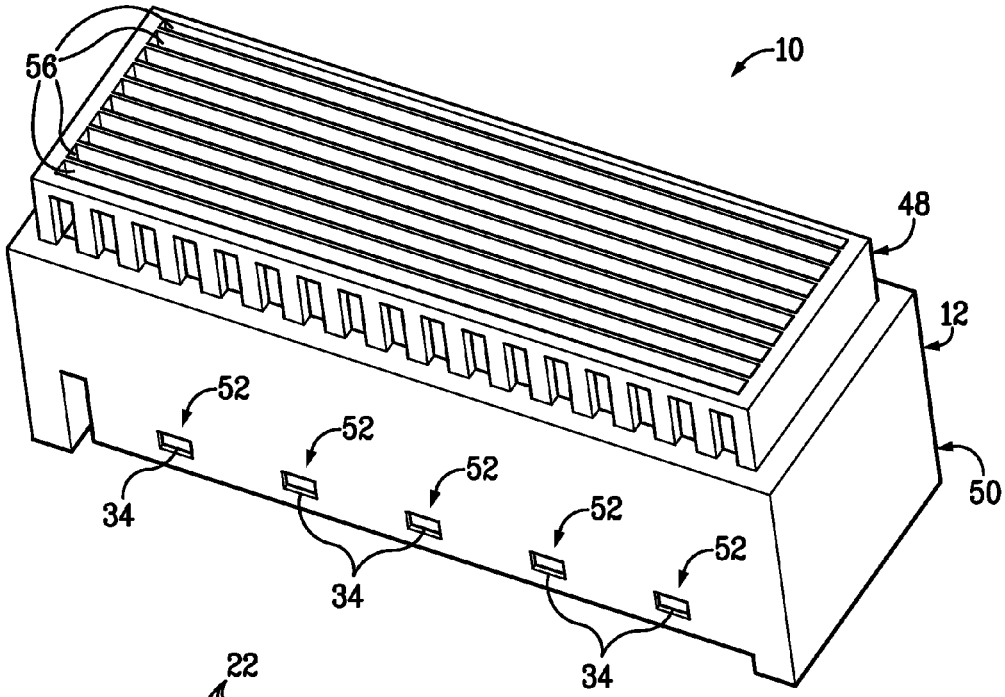
FIG. 1 is a top perspective view of an electrical connector.
Figure 2:
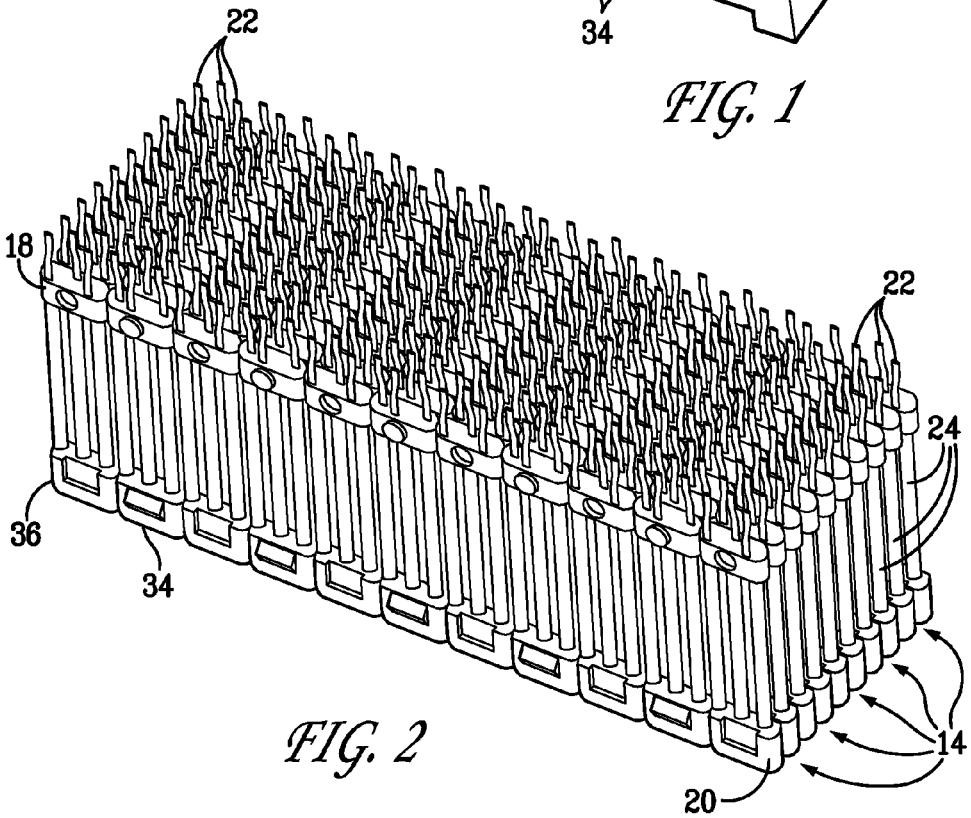
FIG. 2 is a top perspective view of insert molded leadframe assemblies of the connector shown in FIG. 1.

FIGS. 1 through 15 depict an electrical connector 10. The connector 10 can form part of a mezzanine connector system that electrically connects a first and a second electrical device such as a first and a second circuit substrate. The connector 10 comprises an electrically-insulative housing 12, and a plurality of insert molded leadframe assemblies (IMLAs) 14 contained within the housing 12. The connector 10 is depicted with ten of the IMLAs 14 for exemplary purposes only; alternative embodiments can include more, or less than ten of the IMLAs 14.

Each IMLA 14 includes a plurality of electrical conductors 16, and a plurality of fusible elements such as solder balls 17. Each IMLA 14 also includes an electrically-insulative upper frame 18, and an electrically-insulative lower frame 20. The IMLAs 14 are depicted with thirty-three of the electrical conductors 16 and thirty-three of the solder balls 17 for exemplary purposes only; the IMLAs 108 of alternative embodiments can include more, or less than thirty-three of the electrical conductors 16 and solder balls 17.

Each electrical conductor 16 includes a contact beam 22, a lead portion 24 that adjoins the contact beam 22, and a post 26 that adjoins an end of the lead portion 24 distal the contact beam 22. Adjacent ones of the electrical conductors 16 can be oriented so that the contact beams 22 thereof face in opposite directions, as shown in FIGS. 2, 10, 11, and 14.

The upper frame 18 of each IMLA 14 is molded around the lead portions 24 of the associated electrical conductors 16, proximate the associated contact beams 22, as shown in FIGS. 8, 11, 14, and 15. The upper frame 18 has a plurality of cylindrical projections 30 formed thereon. The upper frame 18 also includes a plurality of cylindrical pockets or recesses 32. The projections 30 and the recesses 32 are arranged in an alternating manner on both sides of the upper frame 18, so that the projections 30 of each IMLA 14 are disposed within corresponding recesses 32 of the adjacent IMLAs 14 when the connector 10 is assembled. The projections 30 and the recesses 32 are sized so that each projection 30 fits snugly within the corresponding recess 32. The engagement of the projections 30 and the periphery of the associated recesses 32 of the adjacent IMLAs 14 helps to locate and restrain each IMLA 14 in relation to the adjacent IMLAs 14.

The lower frame 20 of each IMLA 14 is molded around the lead portions 24 of the associated electrical conductors 16, proximate the associated posts 26, as shown in FIGS. 8 and 10-15. The lower frame 20 has a plurality of rectangular projections 34 formed thereon. The upper frame 18 also includes a plurality of rectangular pockets or recesses 36. The projections 34 and the recesses 36 are arranged in an alternating manner on both sides of the lower frame 20, so that the projections 34 of each IMLA 14 are disposed in corresponding recesses 36 of the adjacent IMLAs 14 when the connector 10 is assembled. The projections 30 and the recesses 32 are sized so that each projection 30 fits snugly within the corresponding recess 32. The engagement of the projections 32 and the periphery of the associated recesses 34 of the adjacent IMLAs 14 helps to locate and restrain each IMLA 14 in relation to the adjacent IMLAs 14.

Figure 12:
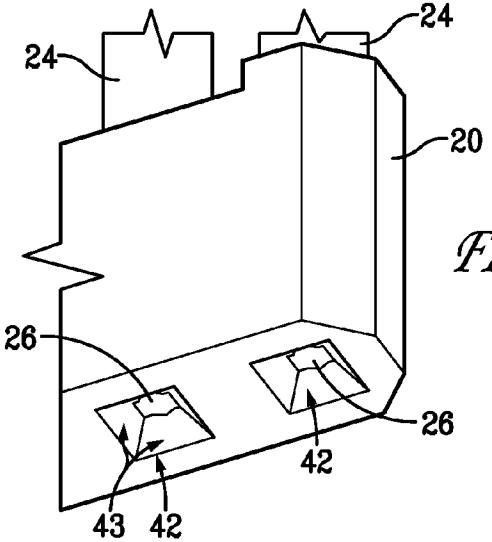
FIG. 12 is a magnified view of the area designated "A" in FIG. 11, depicting the insert molded leadframe assembly without solder balls.
Figure 13:
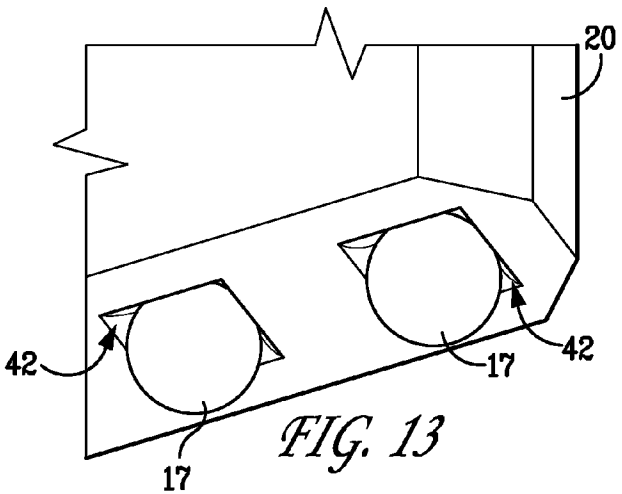
FIG. 13 is a magnified view of the area designated "A" in FIG. 11, depicting the insert molded leadframe assembly with solder balls.
Figure 11:
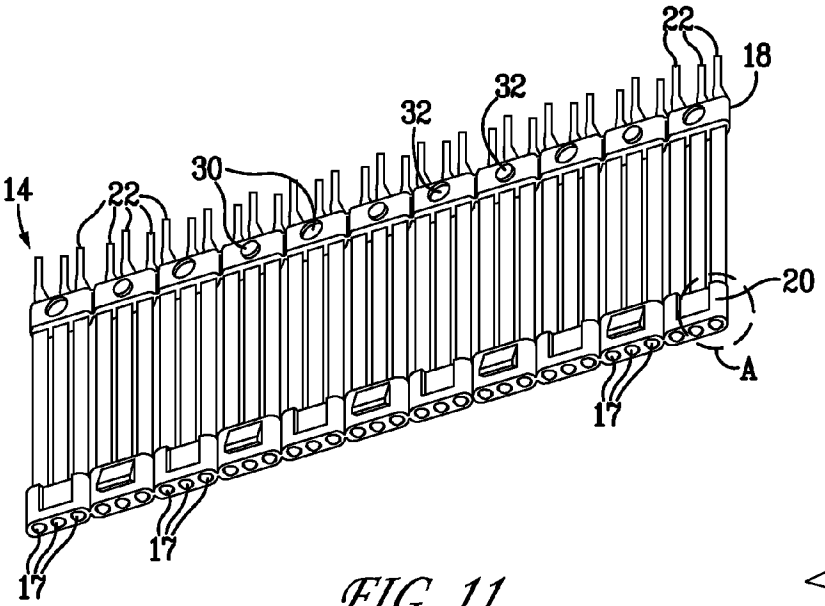
FIG. 11 is a bottom perspective view of the insert molded leadframe assembly shown in FIGS. 2 and 7-10.
Figure 14:
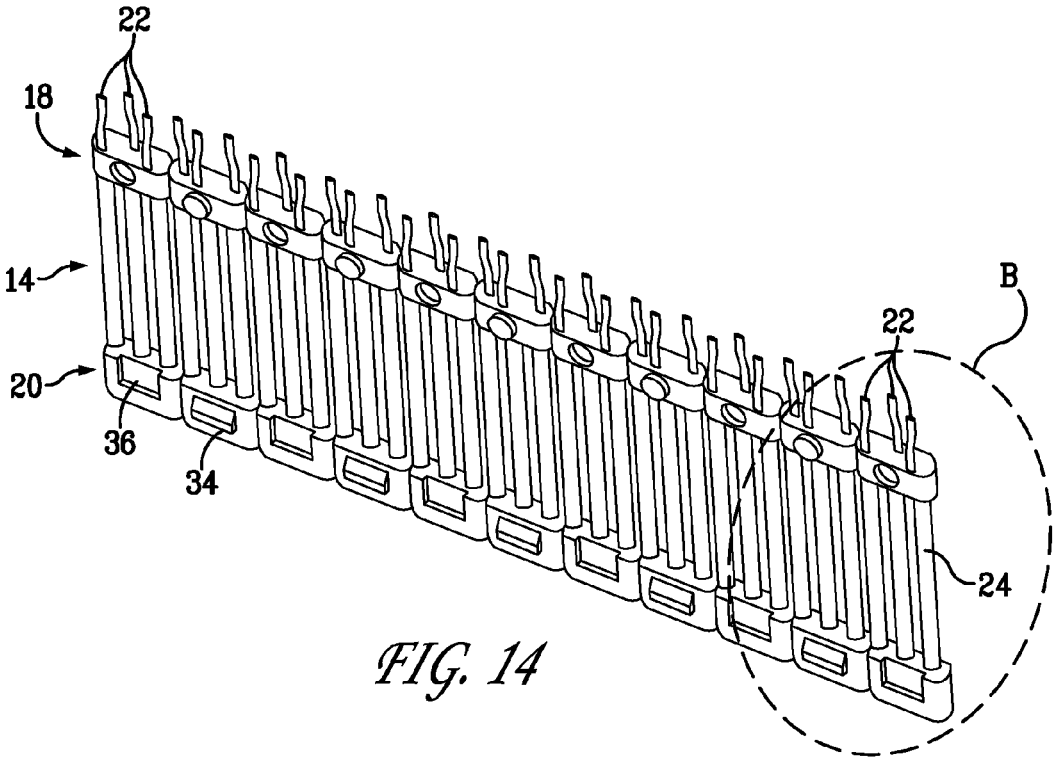
FIG. 14 is a top perspective view of the insert molded leadframe assembly shown in FIGS. 2 and 7-13.
Figure 15:
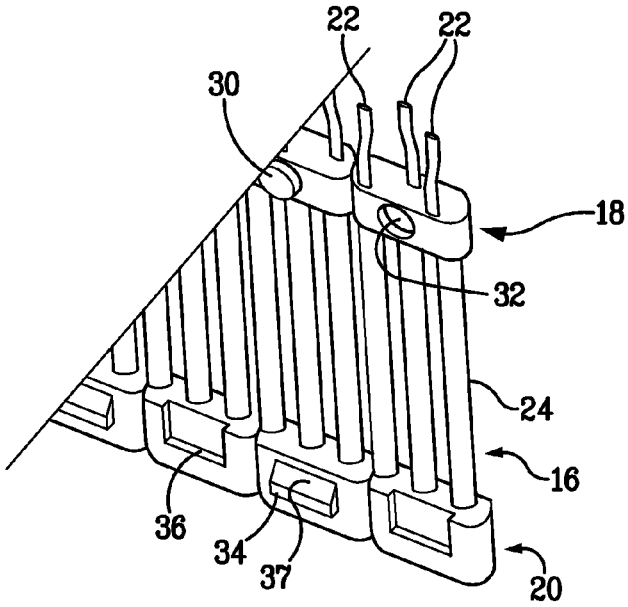
FIG. 15 is a magnified view of the area designated "B" in FIG. 14.
Figure 16:
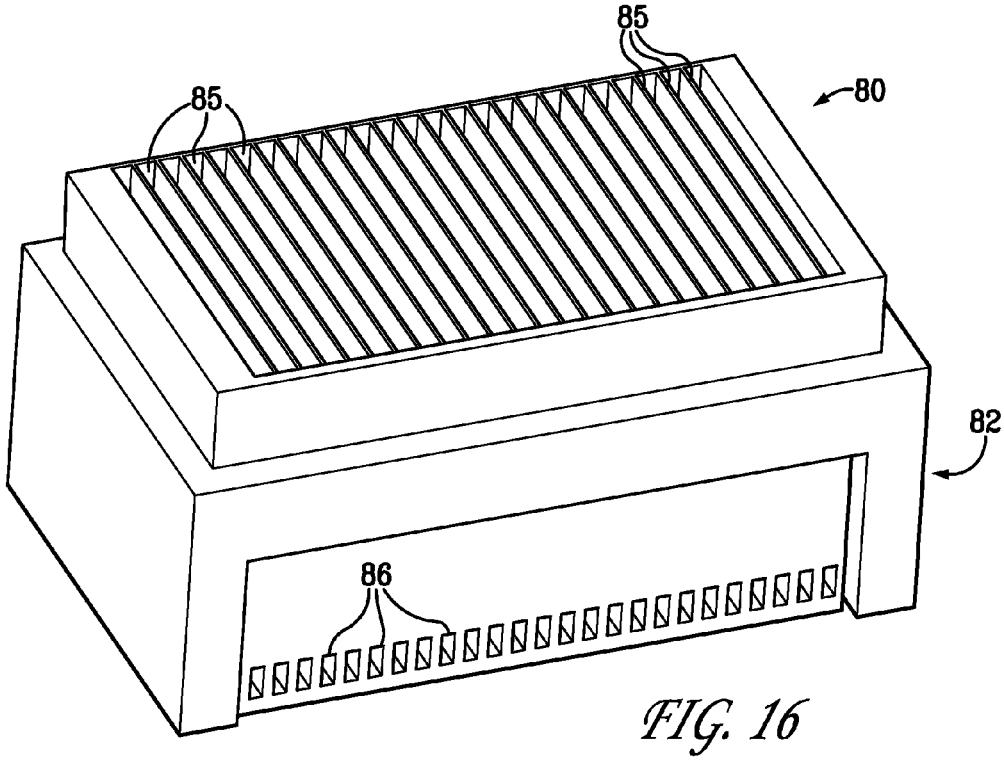
FIG. 16 is a top perspective view of an alternative embodiment of the electrical connector shown in FIG. 1.
Figure 17:
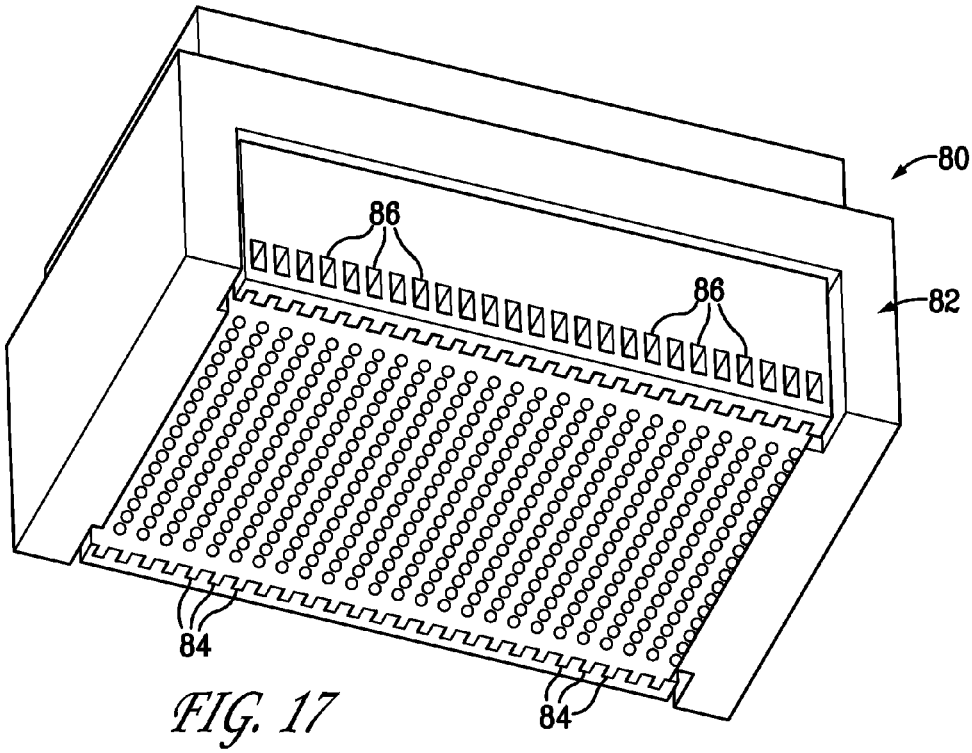
FIG. 17 is a bottom perspective view of the connector shown in FIG. 16.
Figure 19:
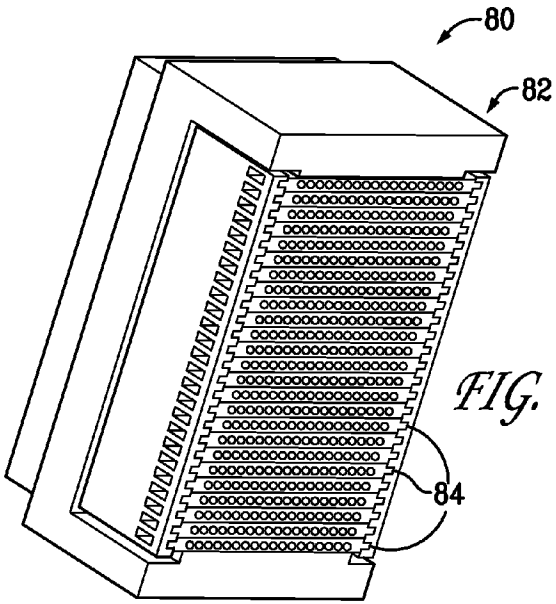
FIG. 19 is a bottom perspective view of the connector shown in FIGS. 16-18.
Figure 18:
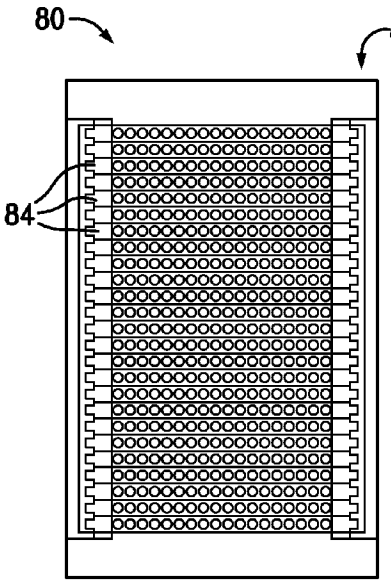
FIG. 18 is a bottom view of the connector shown in FIGS. 16 and 17.
Figure 21:
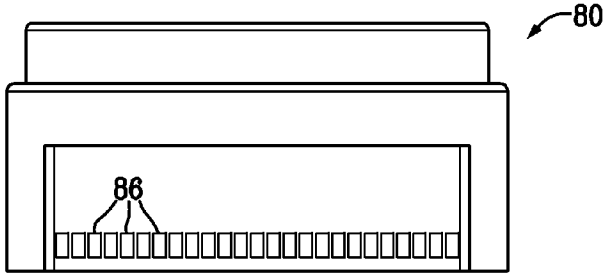
FIG. 21 is a side view of the connector shown in FIGS. 16-20, from a perspective rotated approximately ninety degrees form the perspective of FIG. 20.
Figure 20:
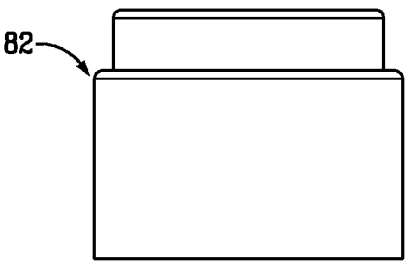
FIG. 20 is a side view of the connector shown in FIGS. 16-19.

The lower frame 20 has a plurality of pockets 42 formed therein, as shown in FIGS. 12 and 13. Each post 26 is located, in part, within an associated one of the pockets 42. Each pocket 40 is defined by four substantially flat surfaces 43, as shown in FIG. 12. Each surface 43 is angled in relation to the longitudinal centerline of the associated post 26.

Each solder ball 17 is positioned, in part, within an associated pocket 42 of the lower frame 20. The solder balls 17 are subjected to a solder reflow process after the connector 10 has been placed on its mating substrate (not shown). The solder reflow process melts the solder balls 17. The molten solder, upon cooling, forms solder connections between the electrical conductors 16 and associated contact pads on the mating substrate. The angled surfaces 43 of the pockets 42 help to locate the solder balls 17 and the molten solder during the reflow process, and thereby assist in the proper formation of the resulting solder connections.

Integrating the pockets 42 into the lower frame 20 of each IMLA 14 can obviate the need for a separate structure in addition to the housing 12, or for additional structure in the housing 12 itself, to accommodate the solder balls 17. Moreover, the IMLAs 14 can be molded in continuous strips and then cut to a desired length to accommodate differently sized housings 12 used in different applications, thereby obviating the need for different tooling to manufacture IMLAs 14 of different lengths.

Figure 4:
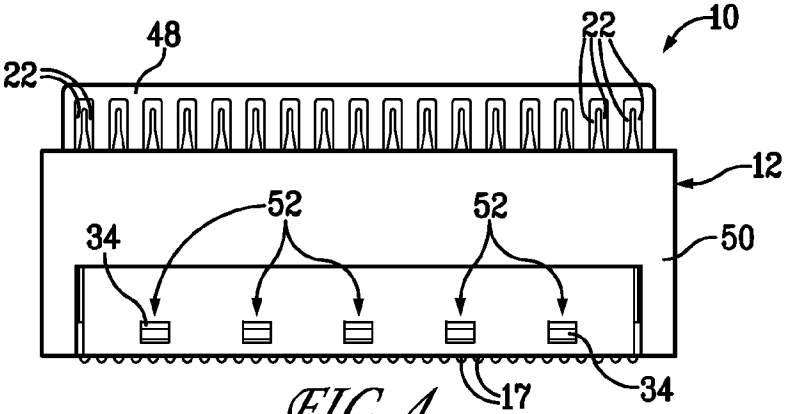
FIG. 4 is a side view of the connector shown in FIGS. 1-3.
Figure 6:
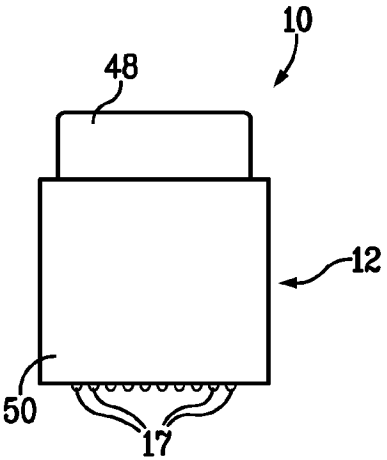
FIG. 6 is a side view of the connector shown in FIGS. 1-5, from a perspective rotated approximately ninety degrees form the perspective of FIG. 4.

The housing 12 includes an upper portion 48 and a lower portion 50. Penetrations 52 can be formed in a sidewall of the lower portion 50, as shown in FIGS. 1 and 4. Each penetration 52 receives an associated projection 34 of one of the outermost IMLAs 14. Interference between the projections 34 and the peripheral surfaces of the penetrations 52 helps to retain the IMLAs 14 in the housing 12.

Figure 3:
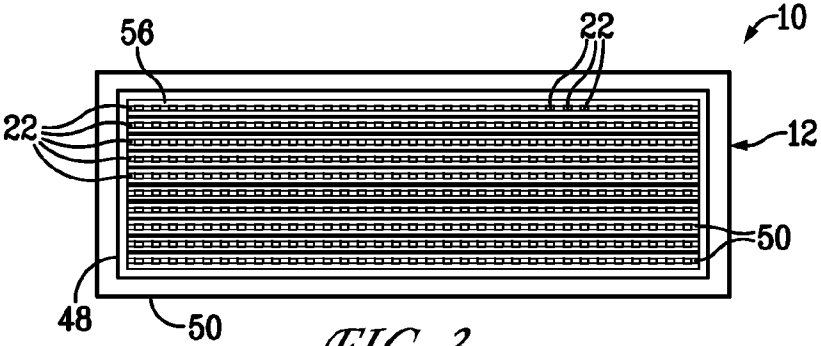
FIG. 3 is a top view of the connector shown in FIGS. 1 and 2.
Figure 5:
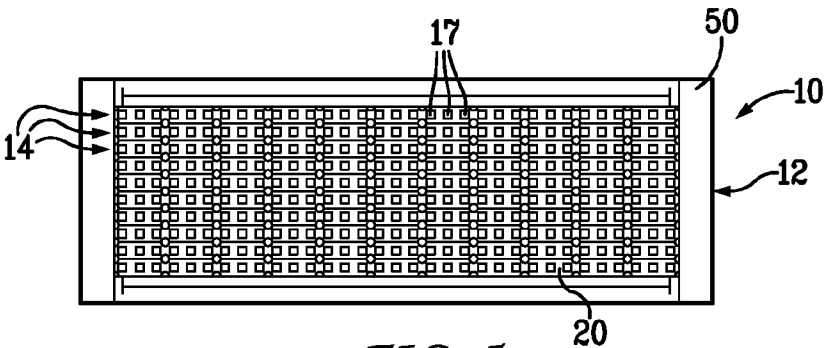
FIG. 5 is a bottom view of the connector shown in FIGS. 1-4.
Figure 10:
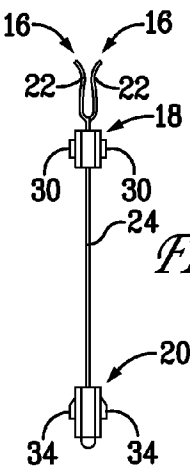
FIG. 10 is a side view of the insert molded leadframe assembly shown in FIGS. 2 and 7-9, from a perspective rotated approximately ninety degrees form the perspective of FIG. 8.
Figure 7:
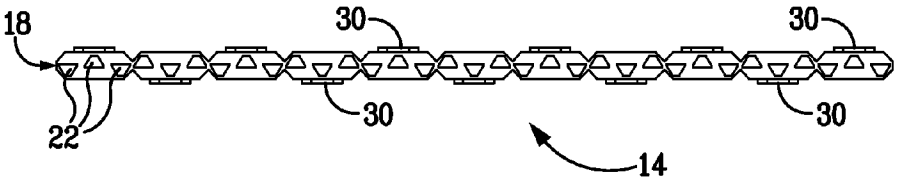
FIG. 7 is a top view of one of the insert molded leadframe assemblies shown in FIG. 2.
Figure 8:
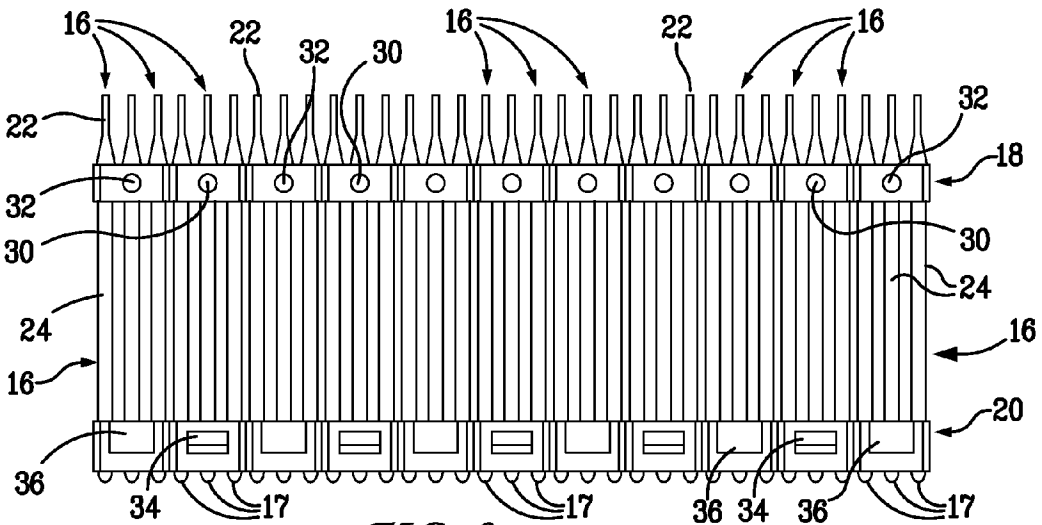
FIG. 8 is a side view of the insert molded leadframe assembly shown in FIGS. 2 and 7.
Figure 9:
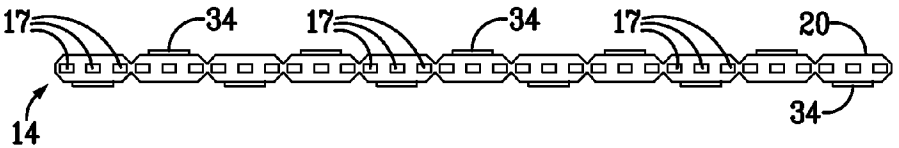
FIG. 9 is a bottom view of the insert molded leadframe assembly shown in FIGS. 2, 7, and 8.

The contact beams 22 of the electrical conductors 16 are located within the upper portion 48 of the housing 12. The upper portion 48 has slots 56 formed therein, as shown in FIGS. 1 and 3. Each slot 56 extends along the lengthwise direction of the upper portion 48, and is positioned above an associated IMLA 14. The slots 56 provide contacts of a mating connector (not shown) with access to the contact beams 22. The slots 56 also provide clearance between the contact beams 22 and the adjacent surfaces of the upper portion 48 of the housing 12, to accommodate the deflection of the contact beams 22 that occurs when the contact beams 22 are mated with the contacts of the mating connector.

FIGS. 16-21 depict an alternative embodiment of the connector 10 in the form of a connector 80. The connector 80 includes a housing 82, and a plurality of IMLAs 84. The IMLAs 84 are shorter than the IMLAs 14, so that the IMLAs 84 can be oriented substantially perpendicular to the lengthwise direction of the housing 82. The IMLAs 84 otherwise are substantially similar to the IMLAs 14.

The housing 82 has slots 85 formed therein. Each slot 85 extends along a direction substantially perpendicular to the lengthwise direction of the housing 82, and is positioned above an associated IMLA 84. The slots 85 provide contacts of a mating connector (not shown) with access to contact beams of the IMLAs 84.

The housing 82 has penetrations 86 formed therein. Each penetration 86 receives an end of a lower frame of an associated one of the IMLAs 84, to retain the IMLAs 84 in the housing 82.

FIGS. 22 through 31 depict another alternative embodiment in the form of an electrical connector 100. The connector 100 includes a first half 102, and a second half 104 that mates with the first half 102. The first half 102 and the second half 104 are hermaphroditic, i.e., the first half 102 and the second half 104 are non-gender-specific.

The first half 102 and the second half 104 of the connector 100 are substantially identical. The following comments concerning the components of the first half 102 apply equally to the second half 104, unless otherwise noted.

The first half 102 comprises a housing 106, and a plurality of IMLAs 108 contained within the housing 106. The connector 100 is depicted with six of the IMLAs 108 for exemplary purposes only; alternative embodiments can include more, or less than six of the IMLAs 108.

The housing 106 of the first half 102 is configured to mate with a substantially identical housing 106 of the second half 104. Each housing 106 includes a sidewall 112. The sidewall 112 includes a first portion 114 and a second portion 116 that together form the top of the sidewall 112 (from the perspective of FIG. 23). The first portion 114 is thinned so that the first portion 112 is recessed in relation to the outwardly-facing surfaces of the sidewall 112, and defines an outwardly-facing recess 117, as shown in FIG. 23. The second portion 116 is thinned so that the second portion 116 is recessed in relation of the inwardly-facing surfaces of the sidewall 112, and defines an inwardly-facing recess 118.

The first portion 114 of the sidewall 112 of each housing 106 is received within the recess 118 of the other housing 106 when the first and second halves 102, 104 are mated. The second portion 116 of the sidewall 112 of each housing 106 is received within the recess 117 of the other housing 106 when the first and second halves 102, 104 are mated. The first and second portions 114, 116 and the recesses 117, 118 provide a visual indication that the first and second halves 102, 104 are properly oriented during mating, and help to guide the first and second halves 102, 104 during mating.

Each housing 106 also includes a first end portion 120 and a second end portion 122, as shown in FIGS. 22-24. The first and second end portions 120, 122 each have a bore 124 formed therein. A pin 125, shown in FIGS. 22 and 23, is fit snugly within the bore 124 of the first end portion 120 of each housing 106. The pin 125 fits snugly within the bore 124 of the second end portion 122 of the other housing 106 when the first half 102 and the second half 104 are mated. The pins 124 help to guide the first and second halves 102, 104 as the first and second halves 102, 104 are mated. Moreover, friction between the pins 124 and the peripheral surfaces of the bores 124 helps to maintain the first and second halves 102, 104 in a mated condition.

The second end portion 122 extends over substantially the entire height of the housing 106, as shown in FIG. 24. The first end portion 120 is relatively short in comparison to the second end portion 122. More particularly, the top of the second end portion 122 is approximately even with the bottom of the first portion 114 of the sidewall 112 (from the perspective of FIG. 24). This feature prevents the first end portion 120 of each housing 106 from interfering with the second end portion 122 of the other housing 106 when the first and second halves 102, 104 are mated.

Figure 29:
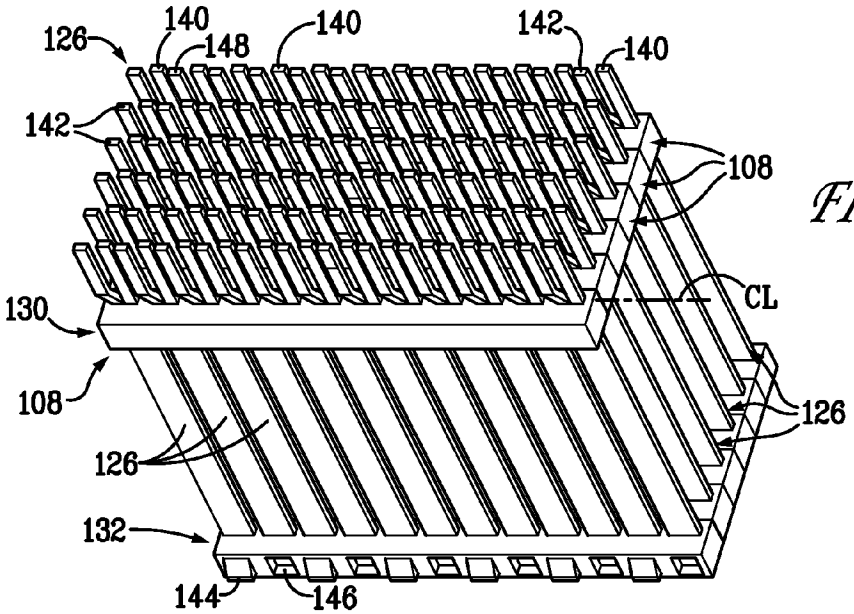
FIG. 29 is a top perspective view of insert molded leadframe assemblies of the connector shown in FIGS. 22-28.
Figure 30:
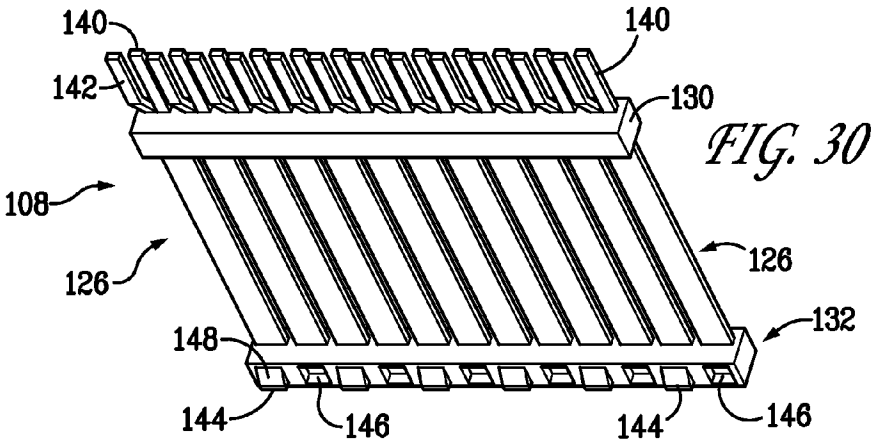
FIG. 30 is a top perspective view of one of the insert molded leadframe assemblies shown in FIG. 29.

Each IMLA 108 includes a plurality of electrical conductors 126, and a plurality of fusible elements such as solder balls 128. The IMLAs 108 are depicted in FIGS. 29 and 30. Each IMLA 108 also includes an electrically-insulative upper frame 130, and an electrically-insulative lower frame 132. The IMLAs 108 are depicted with twelve of the electrical conductors 126 and twelve of the solder balls 128 for exemplary purposes only; the IMLAs 108 of alternative embodiments can include more, or less than twelve of the electrical conductors 126 and solder balls 128.

Figure 28:
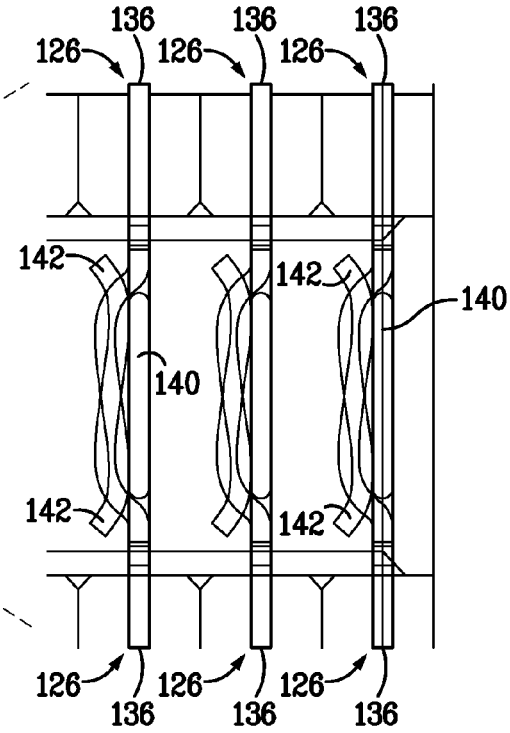
FIG. 28 is a magnified view of the area designated "D" in FIG. 27, with the housings of the first and second halves of the connector made transparent to reveal the mated electrical conductors within the housings.
Figure 31:
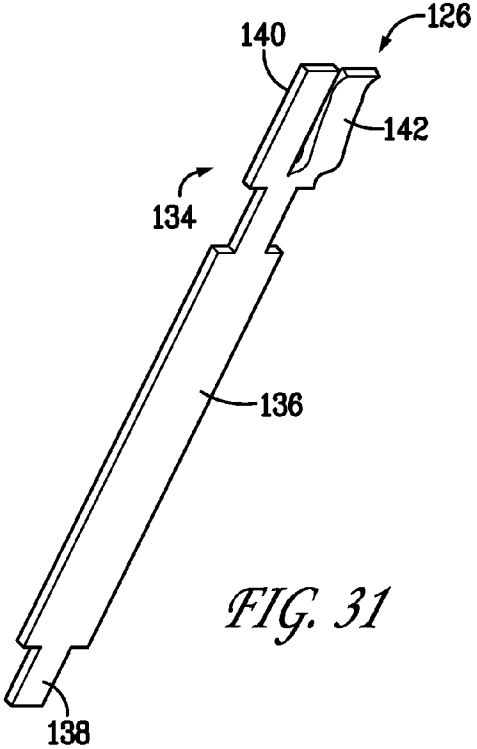
FIG. 31 is a top perspective view of an electrical conductor of the insert molded leadframe assembly shown in FIGS. 29 and 30.

Each electrical conductor 126 includes a contact portion 134, a lead portion 136 that adjoins the contact portion 134, and a post 138 that adjoins the end of the lead portion 136 distal the contact portion 134, as shown in FIG. 31. The contact portion 134 includes a first contact beam 140 and a second contact beam 142 positioned in a side by side relationship. The first contact beam 140 is substantially straight. The second contact beam 142 is angled in relation to the longitudinal axis of the lead portion 136, as shown in FIGS. 28 and 31.

The upper frame 130 of each IMLA 108 is molded around the lead portions 136 of the associated electrical conductors 126, proximate the associated contact portion 134, as shown in FIG. 30.

The lower frame 132 of each IMLA 108 is molded around the lead portions 136 of the associated electrical conductors 126, proximate the associated post 138, as shown in FIG. 30. The lower frame 132 has a plurality of projections 144 formed thereon. The lower frame 132 also has a plurality of pockets or recesses 146 formed therein. The projections 144 and the recesses 146 are arranged in an alternating manner on both sides of the lower frame 132. This arrangement causes the projections 144 of each IMLA 108 to become disposed within corresponding recesses 146 of the adjacent IMLAs 108 when the IMLAs 108 are positioned within their associated housings 106.

The projections 144 and the recesses 146 are sized so that each projection 144 fits snugly within the corresponding recess 146 of the adjacent IMLA 108. The engagement of the projections 144 and the periphery of the associated recesses 146 of the adjacent IMLAs 108 helps to locate and restrain each IMLA 108 in relation to the adjacent IMLAs 108. Each projection 144 can have a major surface 148 that is angled in relation to the vertical direction as shown in FIGS. 29 and 30, to facilitate assembly and disassembly of the IMLAs 108 within their associated housings 106.

Each housing 106 can have a plurality of inwardly-facing recesses (not shown) formed therein for receiving the projections 144 of the outermost IMLAs. Interference between the projections 144 and the peripheral surfaces of the recesses can help retain the IMLAs 108 in the housing 106.

The upper frames 130 of alternative embodiments can be equipped with recesses and projections such as the recesses 146 and the projections 144 of the lower frames 132.

Figure 26:
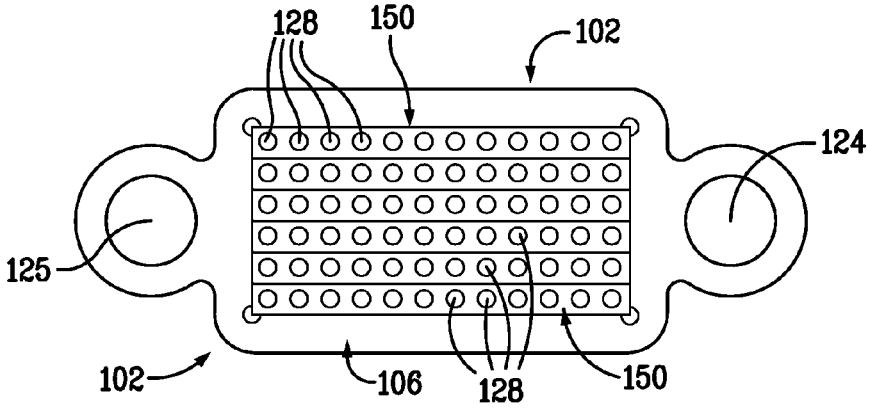
FIG. 26 is a top view of the first half of the connector shown in FIGS. 22-25.
Figure 27:
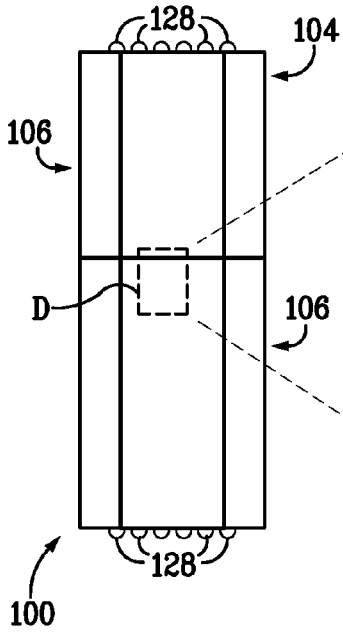
FIG. 27 is a side view of the connector shown in FIGS. 22-26, depicting the first and second halves of the connector in a fully-mated condition, and from a perspective rotated approximately ninety degrees form the perspective of FIG. 24.

The lower frame 132 of each IMLA 108 has a plurality of pockets 150 formed therein, as shown in FIG. 26. Each post 138 of the contacts 126 is located, in part, within an associated one of the pockets 150. Each post 138 has one of the solder balls 128 attached thereto, so that the solder ball 128 is positioned in part within the associated pocket 150. The pockets 150 can be substantially similar to the pockets 42 in the lower frames 30 of the connector 10 described above. The solder balls 128 can be reflowed to form solder connections between the first and second halves 102, 104 of the connector 100 and their respective mounting substrates (not shown).

The configuration of the contact portions 134 of the electrical conductor 126 permits each of the electrical conductors 126 of the first half 102 to mate with an associated electrical conductor 126 of the second half 104 when the first and second halves 102, 104 are mated. In particular, the angled second contact beam 142 of each electrical conductor 126 of the first half 102 contacts and mates with a substantially straight first contact beam 140 of an associated electrical conductor 126 of the second half 104 when the first and second halves 102, 104 are mated, as shown in FIGS. 25 and 28. The first contact beam 140 of each electrical conductor 126 of the first half 102 likewise contacts the second contact beam 142 of an associated one of the electrical conductors 126 of the second half 104 when the first and second halves 102, 104 are mated.

The contact between the associated first and second contact beams 140, 142 of the first and second halves 102, 104 causes each of the second contact beams 142 to resiliently deflect outwardly, away from the associated first contact beam 140, as the first and second halves 102, 104 are mated. The contact between the associated first and second contact beams 140, 142 also causes each of the first contact beams 140 to resiliently deflect outwardly, away from the associated second contact beam 142. The resilient deflection of the first and second contact beams 140, 142 results in a contact force between the associated first and second contact beams 140, 142.

The identical configuration of the first and second halves 102, 104 of the connector 100 helps to minimize the number of different types of parts needed to construct the connector 100, in comparison to a non-hermaphroditic connector of comparable capabilities. Manufacturing, tooling, and inventory-related costs thereby can potentially be reduced due to the identical configuration of the first and second halves 102, 104. Moreover, the IMLAs 108 can be molded in continuous strips and then cut to a desired length, to accommodate differently sized housings 106 used in different applications.

FIGS. 32 through 45 depict another alternative embodiment in the form of an electrical connector 200. The connector 200 includes a first half 202, and a second half 204 that mates with the first half 202. The first half 202 and the second half 204 are hermaphroditic.

The first half 202 and the second half 204 of the connector 200 are substantially identical. The following comments concerning the components of the first half 202 apply equally to the second half 204, unless otherwise noted.

The first half 202 comprises a housing 206, and a plurality of IMLAs 208 contained within the housing 206. The first half 202 is depicted with less than all of its IMLAs 208, for clarity of illustration.

Figure 33:
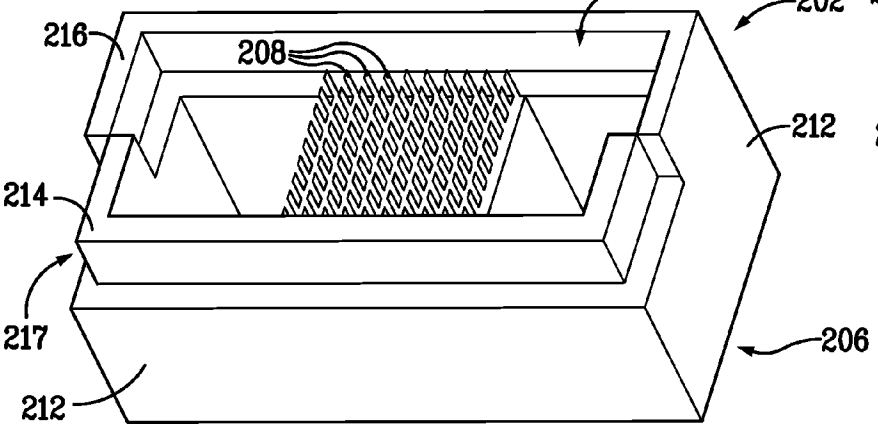
FIG. 33 is a top perspective view of the first half of the connector shown in FIG. 22.
Figure 36:
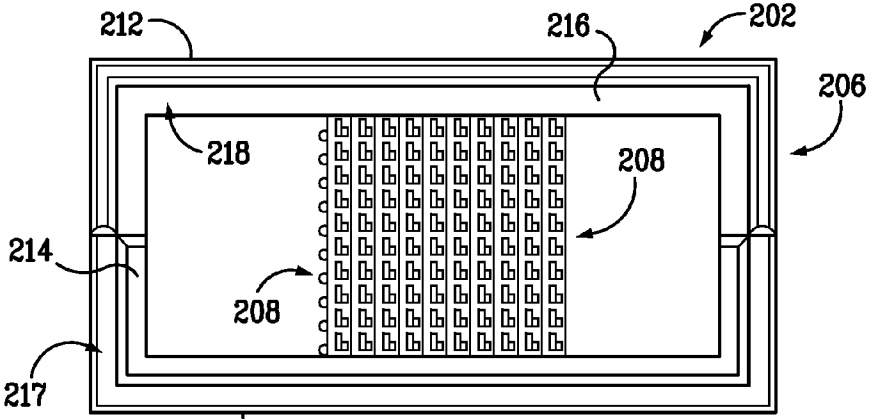
FIG. 36 is a top view of the first half of the connector shown in FIGS. 32-35.
Figure 37:
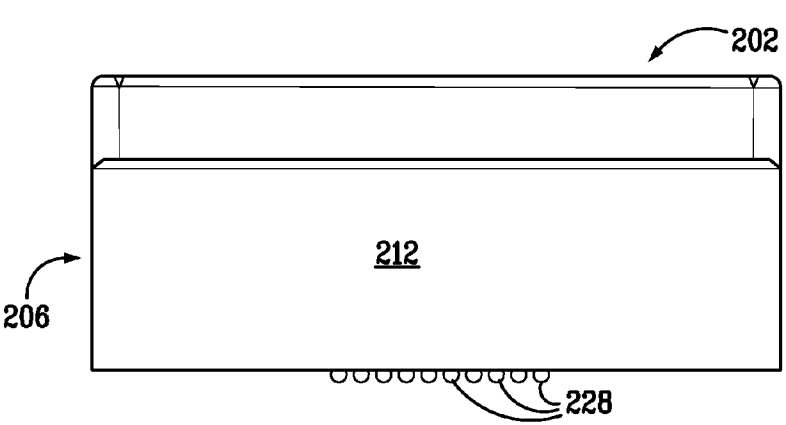
FIG. 37 is a side view of the first half of the connector shown in FIGS. 32-36.
Figure 38:
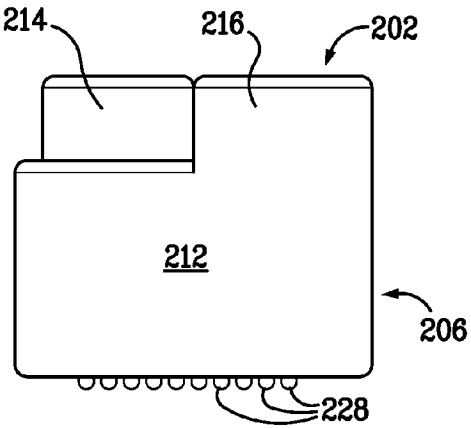
FIG. 38 is a side view of the first half of the connector shown in FIGS. 32-37, from a perspective rotated approximately ninety degrees from the perspective of FIG. 37.

The housing 206 of the first half 202 is configured to mate with a substantially identical housing 206 of the second half 204. Each housing 206 includes a sidewall 212. The sidewall 212 includes a first portion 214 and a second portion 216 that together form the top of the sidewall 212 (from the perspective of FIG. 33). The first portion 214 is thinned so that the first portion 212 is recessed in relation to the outwardly-facing surfaces of the sidewall 212, and defines an outwardly-facing recess 217 as shown in FIGS. 33 and 36. The second portion 216 is thinned so that the second portion 216 is recessed in relation of the inwardly-facing surfaces of the sidewall 212, and defines an inwardly-facing recess 218.

The first portion 214 of the sidewall 212 of each housing 206 is received within the recess 218 of the other housing 106 when the first and second halves 102, 104 are mated. The second portion 216 of the sidewall 212 of each housing 206 is received within the recess 217 of the other housing 206 when the first and second halves 202, 204 are mated. The first and second portions 214, 216 and the recesses 217, 218 provide a visual indication that the first and second halves 202, 204 are properly oriented during mating, and help to guide the first and second halves 202, 204 during mating.

Each IMLA 208 includes a plurality of electrical conductors 226, and a plurality of fusible elements such as solder balls 228, as shown in FIGS. 39-45. Each IMLA 208 also includes an electrically-insulative frame 230. The IMLAs 208 are depicted with ten of the electrical conductors 226 and ten of the solder balls 228 for exemplary purposes only; the IMLAs 208 of alternative embodiments can include more, or less than ten of the electrical conductors 226 and ten of the solder balls 228.

Figure 41:
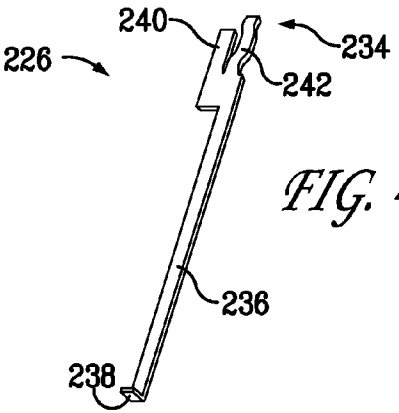
FIG. 41 is a top perspective view of an electrical conductor of the insert molded leadframe assembly shown in FIGS. 39 and 40.
Figure 34:
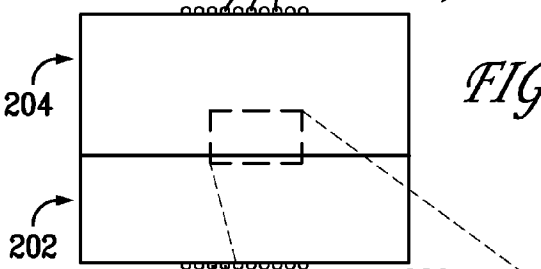
FIG. 34 is a side view of the connector shown in FIGS. 32 and 33, depicting the first and second halves of the connector in a fully mated condition.
Figure 35:
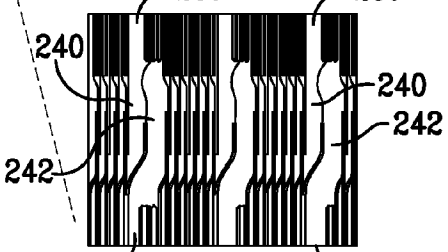
FIG. 35 is a magnified view of the area designated "E" in FIG. 34, with housings of the first and second halves of the connector made transparent to reveal mated electrical conductors within the housings.
Figure 32:
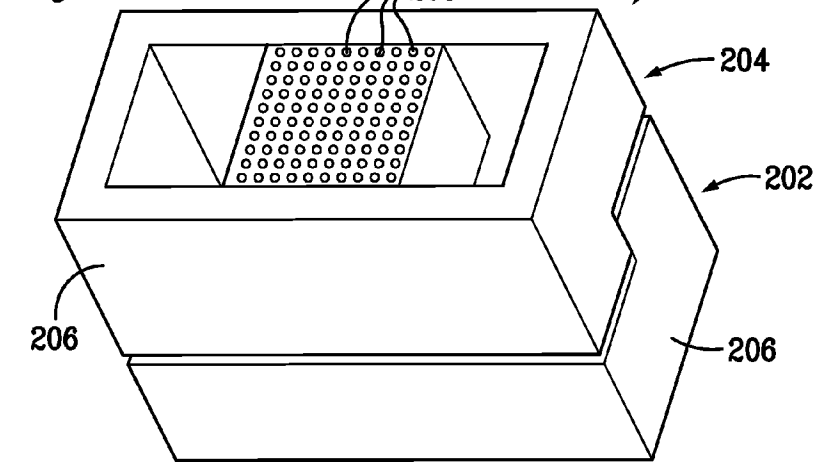
FIG. 32 is a top perspective view of another alternative embodiment of the electrical connector shown in FIG. 1, depicting first and second halves of the connector in a partially mated condition.

Each electrical conductor 226 includes a contact portion 234, and a lead portion 236 that adjoins the contact portion 234, as shown in FIGS. 41-43. Each electrical conductor 226 also includes a ball paddle 238. The ball paddle 238 adjoins the end of the lead portion 236 distal the contact portion 234, and is oriented substantially perpendicular to the longitudinal axis of the lead portion 236.

The contact portion 234 includes a first contact beam 240 and a second contact beam 242 positioned in a side by side relationship, as shown in FIG. 39-45. The first contact beam 240 is substantially straight. A portion of the second contact beam 242 is angled so that the second contact beam 242 is offset in relation to the longitudinal axis of the lead portion 236, as shown in FIGS. 43 and 45.

The frame 230 of each IMLA 208 is molded around the lead portions 236 of the associated electrical conductors 226. The upper and lower ends of each frame 230 are thickened in relation to the remainder of the frame 230 as shown in FIG. 45, to facilitate spacing between adjacent IMLAs 208.

Each ball paddle 238 of the electrical conductors 226 has one of the solder balls 228 attached thereto, as shown in FIGS. 39, 44, and 45. The solder balls 228 can be reflowed to form solder connections between the first and second halves 202, 204 of the connector 200 and their respective mounting substrates (not shown).

The configuration of the contact portions 234 of the electrical conductor 226 permits each of the electrical conductors 226 of the first half 202 to mate with an associated electrical conductor 226 of the second half 204 when the first and second halves 202, 204 are mated. In particular, the offset second contact beam 242 of each electrical conductor 226 of the first half 202 contacts and mates with a substantially straight first contact beam 240 of an associated electrical conductor 226 of the second half 204 when the first and second halves 202, 204 are mated, as shown in FIG. 36. The first contact beam 240 of each electrical conductor 226 of the first half 202 likewise contacts the second contact beam 242 of an associated one of the electrical conductors 226 of the second half 204 when the first and second halves 202, 204 are mated.

The contact between the associated first and second contact beams 240, 242 of the first and second halves 202, 204 causes each of the second contact beams 242 to resiliently deflect outwardly, away from the associated first contact beams 202, as the first and second halves 202, 204 are mated. The contact between the associated first and second contact beams 202, 204 also causes each of the first contact beams 202 to resiliently deflect outwardly, away from the associated second contact beam 204. The resilient deflection of the first and second contact beams 240, 242 results in a contact force between the associated first and second contact beams 240, 242.

The identical configuration of the first and second halves 202, 204 of the connector 200 helps to minimize the number of different types of parts needed to construct the connector 200, in comparison to a non-hermaphroditic connector of comparable capabilities. Moreover, the IMLAs 208 can be molded in continuous strips and then cut to a desired length, to accommodate differently sized housings 206 used in different applications.

What is claimed:

1. An electrical connector comprising:

a housing including a first half and a second half that is configured to mate with the first half, the first half retaining a first plurality of electrical conductors and defining a first opening disposed adjacent to a first projection of the first half, and the second half retaining a second plurality of electrical conductors and defining a second opening disposed adjacent to a second projection of the second half, wherein the first projection is received in the second opening and the second projection is received in the first opening when the first and second halves are mated to each other so as to electrically connect the first and second pluralities of electrical conductors, wherein each of the first and second halves define side walls of equal height on opposed sides of the respective first and second pluralities of electrical conductors and opposed end walls that extend between respective ends of the side walls, and wherein the opening of each of the first and second halves extends along an entirety of the length of at least one of the respective walls, and the projection of each of the first and second halves extends along an entirety of the length of at least one of the respective walls.

2. The electrical connector as recited in claim 1, wherein the first and second projections and the first and second openings extend along the side walls of the respective first and second halves.

3. The electrical connector as recited in claim 1, wherein the side walls of each of the first and second halves are recessed so as to define the first and second openings and the first and second projections.

4. The electrical connector as recited in claim 1, wherein the first and second halves are devoid of any guide pins and guide pin bores.

5. The electrical connector as recited in claim 1, wherein the first and second halves are constructed substantially identically with respect to each other.

6. The electrical connector as recited in claim 1, wherein the respective wall that carries the opening of the first half is the same wall as the respective wall that carries the projection of the first half.

7. The electrical connector as recited in claim 1, wherein each of the first and second pluralities of electrical conductors comprises:

a first conductor including a first mating end that defines a first contact beam, and a lead portion that extends along a first axis and is in electrical communication with the first contact beam; and a last conductor including a second mating end that defines a second contact beam, and a lead portion that extends along a second axis and is in electrical communication with the second contact beam, wherein the first contact beam is substantially parallel with respect to the first axis and the second contact beam is angled with respect to the second axis.

8. The electrical connector as recited in claim 2, wherein the first and second projections and the first and second openings further extend into the end walls of the respective first and second halves.

9. The electrical connector as recited in claim 3, wherein the openings are defined by inwardly facing recesses and the projections are defined by outwardly facing recesses.

10. The electrical connector as recited in claim 6, wherein the respective wall that carries opening of the second half is the same wall as the respective wall that carries the projection of the second half.

* * * * *